US006338162B1

(12) United States Patent
Geng

(10) Patent No.: US 6,338,162 B1
(45) Date of Patent: Jan. 15, 2002

(54) ELECTROSTATIC GROUNDING GLOVE

(75) Inventor: Tony Geng, Ontario (CA)

(73) Assignee: Superior Glove Works Ltd, Acton (CA)

( * ) Notice: Subject to any disclaimer, the term of this patent is extended or adjusted under 35 U.S.C. 154(b) by 0 days.

(21) Appl. No.: 09/644,063

(22) Filed: Aug. 23, 2000

(51) Int. Cl.[7] ..... A41D 19/00
(52) U.S. Cl. ..... 2/161.6; 2/167
(58) Field of Search ..... 2/16, 20, 21, 159, 2/161.6, 167; 222/192, 212, 386; 361/212, 215, 220; 57/901

(56) References Cited

U.S. PATENT DOCUMENTS 2,712,098 A * 6/1955 Legge ..... 361/220
3,596,134 A * 7/1971 Burke ..... 317/2
3,648,109 A * 3/1972 Tims et al. ..... 317/2
4,373,175 A * 2/1983 Mykkanen ..... 361/220
4,639,825 A * 1/1987 Breidegam ..... 361/212
4,654,748 A * 3/1987 Rees ..... 361/220
4,660,228 A 4/1987 Ogawa et al.
4,698,724 A * 10/1987 Burvee ..... 361/220
4,992,335 A 2/1991 Guerra et al.
5,248,548 A 9/1993 Toon
5,686,897 A * 11/1997 Loh ..... 340/649
5,704,066 A 1/1998 Yamamoto
5,855,301 A 1/1999 Mykkanen et al.
6,026,512 A * 2/2000 Banks ..... 2/69

* cited by examiner

*Primary Examiner*—John J. Calvert
*Assistant Examiner*—Katherine Moran
(74) *Attorney, Agent, or Firm*—Ingrid E. Schmidt

(57) ABSTRACT

An electrostatic grounding hand covering in the form of a glove, made from a relatively nonconductive material such as acrylonitrile-butadiene copolymer, or other polymer or polymer blend, and having an electrically conductive tape on inner and outer surfaces of the glove. The electrically conductive tape runs from the outside surface to the inner and provides a path for an electrostatic charge to pass between an object in contact with the electrically conductive tape and the hand and finally to ground.

7 Claims, 3 Drawing Sheets

ELECTROSTATIC GROUNDING GLOVE

FIELD OF THE INVENTION

This invention relates to a hand covering for controlling electrostatic discharges, specifically by grounding an operator in an electrostatic environment.

BACKGROUND OF THE INVENTION

Naphtha and methyl ethyl ketone are organic solvents used in automotive painting. To prevent operators from coming into skin contact with these solvents, it is necessary for them to wear some form of chemically resistant hand covering. Traditionally, such hand covering has been gloves made from acrylonitrile-butadiene co-polymers, commonly called nitrile rubber. Nitrile rubber provides good resistance to chemicals used in automotive paint lines. The gloves are generally seamless to prevent any solvent from seeping in. However, cut and sewn polyvinyl chloride gloves are sometimes used when contact with organic solvents is minimal.

In electrostatic painting, the object to be painted is negatively charged while the paint and paint spray dispenser are positively charged. The paint droplets are attracted to the negatively charged object just as the north pole of a magnet is attracted to the south pole of another magnet. This gives even coverage of paint and minimizes waste.

However, if the operator is wearing a glove made of a material which is relatively nonconductive, such as nitrile rubber, it prevents the operator from being adequately grounded and some paint may fly back toward the operator. To prevent this, it is necessary to ground the operator, preferably without sacrificing the operator's protection from the paint solvents.

Various grounding devices have been proposed for a variety of reasons. For example, U.S. Pat. No. 3,596,134 teaches the protection of persons from electrical discharge in electrostatic fields by means of foot sandals, belt, and gloves all interconnected by conductive leads. This ensemble is used to disperse electrical charges concentrated in particular parts of the person's body. The construction of such a glove includes an outer surface of leather with a conductive lining on the inside so that the accumulated charge in the hand area is removed through the inner conductive lining, through the lead to ground. In this configuration, the charge has to pass through the insulative material, such as leather, to the inner lining which presents a substantially high resistive path.

U.S. Pat. No. 5,704,066 teaches the grounding of persons handling spark plug wires by means of a metal mesh glove attached to the metal frame work of the automobile by a conductive wire and alligator clip. Although this structure eliminates the danger of electric shock, it does not fulfill the need for improved protection against skin absorption and skin contact with toxic chemicals or solvents. Also, it is cumbersome to operate and is not cost effective for electrostatic painting.

U.S. Pat. No. 5,855,301 teaches electrostatic grounding for manually operated fluid dispensers, in which an operator is grounded by means of a conductive glove. The glove is made from a synthetic rubber such as Nitrilite from Ansell-Edmont Industrial Inc. of Coshocton, Ohio and which has a resistance of $10^8$ to $10^{11}$ ohms. Although this glove is used in conjunction with a wrist band, this combination by no means provides an easy path for the electric charge, and is cumbersome in operation.

Accordingly, it is an object of this invention to provide a cost-effective solution to controlling electrostatic discharge by providing a conductive path away from a charged object to ground.

It is also an object of the invention to provide a structure with a protective material to mitigate skin contact with toxic chemicals, including aqueous solutions and organic solvents, wherein such a material has a low permeation rate with a high fluid breakthrough time.

SUMMARY OF THE INVENTION

A hand covering in the form of a glove is provided for protecting an operator from solvents used in automotive painting while grounding the operator. This is accomplished by applying conductive tape to a finished glove. The tape is secured to the outer surface of the glove, positioned on the palm side of the glove and extends down the cuff or gauntlet, around to the inside of the glove, back up the cuff or gauntlet to the inside palm of the glove. This allows an electrical charge to be transferred from the paint spray dispenser to the palm of the glove and then to the operator, thereby grounding the operator.

The tape can be applied using a solvent resistant adhesive such as the acrylic adhesive on Scotch™ Electrical Tape 1194. It should be noted that the adhesive can be nonconductive. A variety of gloves can be used, provided that the outer surface is solvent resistant and the tape can be firmly attached.

BRIEF DESCRIPTION OF THE DRAWINGS

Further objects and advantages will become apparent upon reading the following detailed description in conjunction with the drawings, in which.

DETAILED DESCRIPTION OF THE PREFERRED EMBODIMENT

Figure 1:
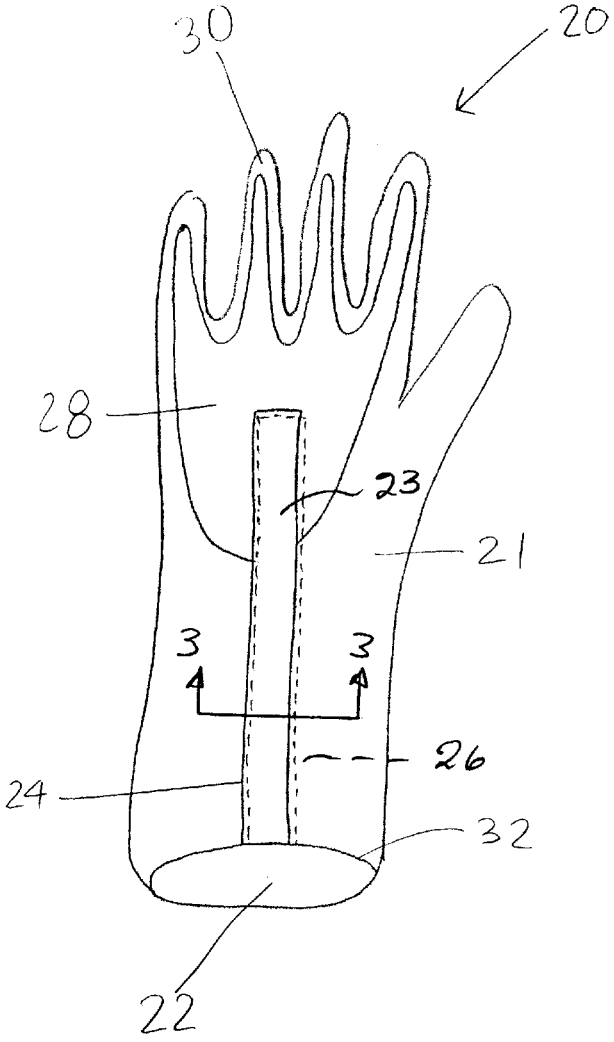
FIG. 1 is a front view of a glove, showing positioning of a first electrically conductive tape portion, shown in solid outline, on the palm side of the glove, and also a second electrically conductive tape portion on the inside of the glove, shown in ghost outline.
Figure 2:
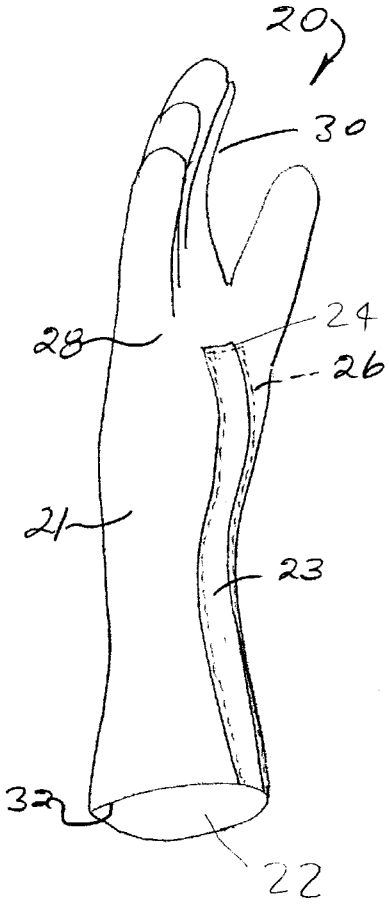
FIG. 2 is a side view of the glove of FIG. 1.
Figure 3:
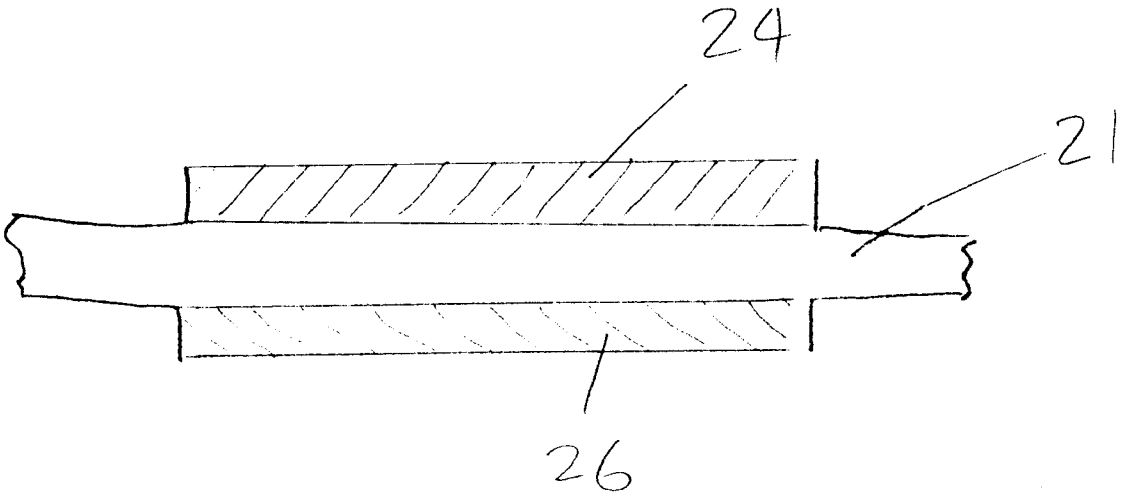
FIG. 3 is a cross-section of the glove of FIG. 1 drawn on line 3—3 of FIG. 1.

In a preferred embodiment shown in FIGS. 1 to 3, a hand covering in the form of a glove for controlling electrostatic discharges is designated generally by reference numeral 20. The glove 20 is made from an insulative material to form a protective housing 21 which includes an outer surface and an inner surface and defines a cavity 22 for receiving a hand. An electrically conductive tape 23 secured on an inner surface of the glove 20 and extending longitudinally to an outer surface of the glove provides an electrical path for electrostatic charge to flow from an operator wearing the glove to ground.

In an electrostatic environment, such as automotive painting, an object is painted by positively charged paint spray emanating from a paint spray dispenser. The object to be painted is negatively charged and the paint is positively charged by ionization, so that the negatively charged object attracts the paint. Typically, the operator is in contact with the positively charged paint spray dispenser, so that the positive charge is transferred to the operator. This results in the negatively charged paint flying back to the operator. The electrically conductive tape 23 is composed of a first electrically conductive portion 24 and a second electrically conductive portion 26. The first electrically conductive portion 24 is secured on the outer surface of the housing 21, while the second electrically conductive portion 26 (drawn in ghost outline) is secured on the inner surface of the housing 21.

The first electrically conductive portion 24 extends from the base of a finger portion 30 of the glove 20 to a cuff 32. The first electrically conductive portion 24 is dimensioned to cover a part of a palm portion 28 of the glove 20, while providing adequate contact with the paint spray dispenser. As mentioned above, the second conductive portion 26 of the tape 23 is secured to the inner surface of the glove 20, and has similar dimensions to the first electrically conductive portion 24 and is electrically coupled thereto. This can be done in several ways. In the preferred embodiment, the first and second conductive portions 24 and 26 form one integral strip which extends from the outer surface of the glove 20 to the inner surface of the glove 20. Thus, the second conductive portion 26 is in contact with the operator's skin on the palm portion 28 of the glove 20, while the first electrically conductive portion 24 is in contact with a paint spray dispenser.

Since the glove material, such as nitrile-butadiene is largely non-conductive, the flow of charge across its surface is limited. However, given the low electrical resistance of the first conductive portion 24, the charge is adapted to flow away easily from the outer surface of the glove 20. The conductive portions 24 and 26 are made from copper or other suitable conductor of low resistivity. Preferably, it is the commercially available Scotch™ Tape 1194 from 3M, Minnesota. This electrically conductive tape 23 is solvent resistant and is coated on one side with pressure sensitive adhesive so that it can be easily bonded to the outer and inner surfaces of the glove 20. Given the electrical coupling between the conductive portions 24 and 26, the adhesive does not need to be conductive.

Thus, in operation, any positive charge on the glove 20 is conducted away from the outer surface of the glove 20 by the first conductive portion 24, through the second electrically conductive portion 26 to the palm side 28 of the operator's hand and, through the operator's body to ground. To complete this circuit, the operator should preferably be wearing non-rubber soled footwear or relatively conductive footwear. In such a situation, the operator is at ground potential and at a potential lower than the paint spray dispenser. The glove housing 21 will be manufactured by conventional means, preferably by dipping a mold shaped in the form of a hand on which a release wax and release agent is applied into nitrile-butadiene or a suitable solvent resistant material, while maintaining uniform thickness. The nitrile-butadiene is then allowed to "set" and is ultimately peeled from the mold. The glove 20 thus forms a housing 21 defining a cavity 22 for receiving a hand. The second conductive portion 26 is secured to the surface of the glove 20 by suitable adhesive. The glove 20 is then turned inside out for securement of the first conductive portion 24 preferably on the palm side 28 of the glove 20.

Referring to FIGS. 1, 2 and 3, it can be seen that the conductive portions 24 and 26 can be of any length provided there is sufficient contact between the paint spray dispenser and the palm side 28 of the glove 20. The portions 24, 26 are positioned back to back and preferably on the palm side of the glove 20. This configuration is ideal because the pressure resulting from the operator grasping the paint spray dispenser decreases the respective interface resistance between the first electrically conductive portion 24 and the paint spray dispenser interface and the second conductive portion 26 and operator's palm interface. This conversely increases the conductive surface at both interfaces which facilitates in the dissipation of charge away from the operator.

Figure 4:
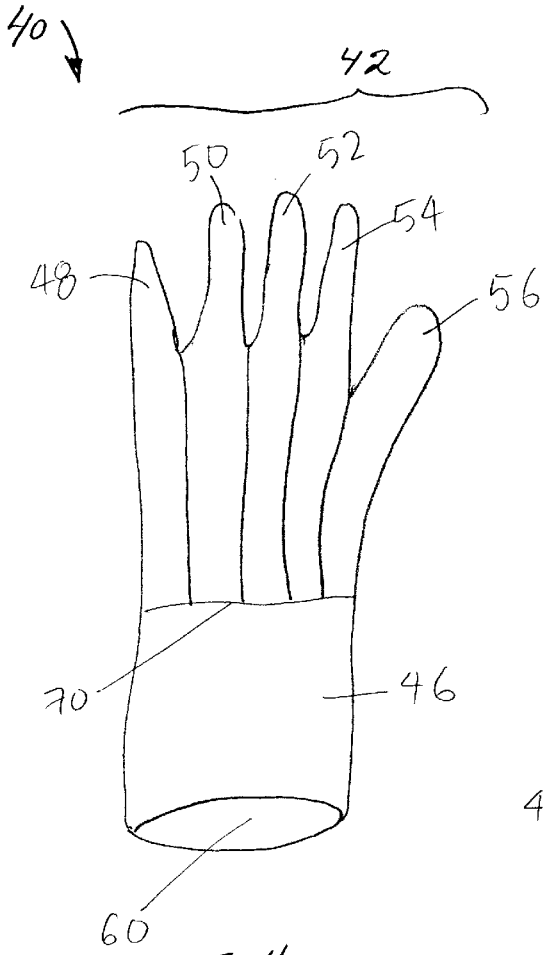
FIG. 4 is a back view of a glove according to a second embodiment, opposite the palm side, showing the fabric parts that are sewn together.
Figure 5:
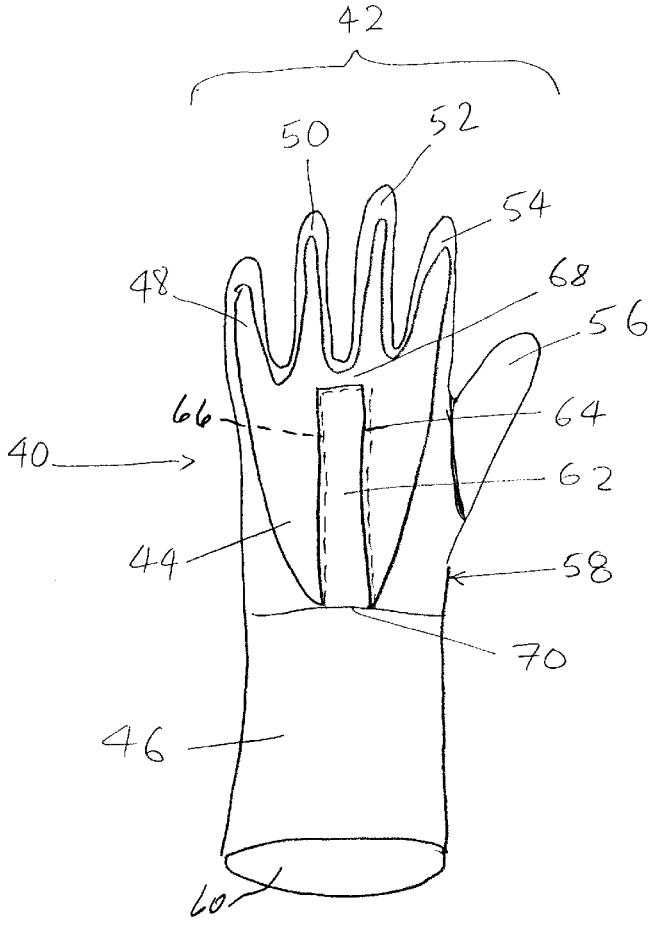
FIG. 5 is a front view of FIG. 4, showing positioning of a first electrically conductive tape portion, shown in solid outline, on the palm side of the glove, and also a second electrically conductive tape portion on the inside of the glove, shown in ghost outline.

In another embodiment shown in FIGS. 4 and 5, a glove 40 has a configuration that includes a finger portion 42, a palm portion 44 and a wrist portion 46. The finger portion 42 and palm portion 44 are made from a plurality of finger sheaths 48, 50, 52, 54 and 56 stitched together in the form of a hand and attached to the wrist portion 46 at a seam 70 which encircles the wrist. Preferably the glove 40 is based on a stitched fabric design and is made from a non-conductive material such as fabric material, polyvinyl chloride, or polyurethane. The glove 40 is fabricated by cutting the individual sheaths 48, 50, 52, 54, 56 and wrist portion 46 with a die, and sewing the individual sheaths 48, 50, 52, 54, 56 and wrist portion 46 together to form a housing 58. A cavity 60 for receiving a hand is thus defined by the housing 58, such that the finished glove 40 has an outer surface and an inner surface.

As in the preferred embodiment of FIGS. 1 to 3, an electrically conductive tape 62 composed of a first electrically conductive tape portion 64 and a second electrically conductive tape portion 66 is applied to the outer and inner surfaces of the glove, respectively. Preferably, the first and second electrical conductive portions 64, 66 are secured to the outer and inner surfaces by adhesive. The electrically conductive portions 64 and 66 are integrally formed and are joined to the glove 40 through the seam 70 before stitching the palm portion 44 at the seam 70 to the wrist portion 46. Referring to FIG. 5, the conductive portions 64, 66 are positioned centrally on the palm portion 44 of the glove 40 and extend from the finger portion 42 to the base of the palm portion. This positioning provides a fairly large contact area with an object, such as a paint spray dispenser, to effectively dissipate the electrostatic charges.

For added comfort and perspiration absorption, the inner surface is preferably lined with a cloth material to interface with the operator's skin such as Goretex™ which conveniently is also lint free. This embodiment is suitable for operation in an environment where the probability of a solvent permeating the glove 40 is reduced.

In use, the gloves described above control the electrostatic charge present on the operator by providing a conductive path for the electrostatic charge through the first conductive and the second conductive portions of the electrically conductive tape. Also, the gloves provide a protective barrier to toxic chemicals, including aqueous solutions and organic solvents by being relatively non-permeable to such fluids.

While only certain preferred embodiments of this invention have been described, it will be understood by those skilled in the art that many variations of this invention may be made without departing from the scope of the appended claims. In particular, the electrically conductive tape may be integrally moulded during fabrication of the glove so as to be integrated into the housing without requiring any adhesive to secure the tape to the inner and outer surfaces of the glove. It will also be appreciated that the hand covering can take the form of a mitten.

I claim:

1. A hand covering for controlling electrostatic discharges, the hand covering defining:

a cavity for receiving a hand and having an outer surface and an inner surface, the inner surface having a first electrically conductive tape portion secured thereon for contacting a hand and, the outer surface having a second electrically conductive portion secured thereon, the second electrically conductive portion being electrically coupled to the first electrically conductive portion, whereby when the second electrically conductive portion is in contact with an object having substantially higher potential than ground, an electrostatic charge flows from the object through the second electrically conductive portion to the first electrically conductive portion and through the hand to ground.

2. A hand covering according to claim 1, wherein said glove is formed from an electrically non-conductive material and the electrically conductive tape portions are bonded to said material.

3. A hand covering according to claim 1, wherein the hand covering is made from a material selected from the group consisting of fabrics, acrylonitrile-butadiene co-polymer and polymers, and any combination thereof.

4. A hand covering according to claim 1, wherein said first and second electrically conductive portions are made from a solvent resistant conductive tape.

5. A glove for controlling electrostatic discharges, the glove having a finger portion, a palm portion and a wrist portion and a cavity for receiving a hand defined by said finger, palm and wrist portions, said wrist portion having a cuff defining an opening for the cavity, the glove having an outer surface and an inner surface, the inner surface having an electrically conductive tape extending longitudinally from the finger portion down the palm portion to the cuff and up to the finger portion on the outer surface, said electrically conductive tape for contacting the hand and an object having substantially higher potential than ground such that an electric circuit is completed between the object and ground.

6. A hand covering for controlling electrostatic discharges, the hand covering having a palm portion joined to a wrist portion at a seam for encircling a wrist, the wrist portion having a cuff defining an opening for a cavity to receive a hand, the hand covering having an outer surface and an inner surface, an electrically conductive tape extending longitudinally down the palm portion on said inner surface and through said seam, and up the palm portion on said outer surface, said electrically conductive tape for contacting the hand and an object having substantially higher potential than ground such that an electric circuit is completed between the object and ground.

7. A hand covering for controlling electrostatic discharges, the hand covering having a palm portion and a cuff defining an opening for a cavity to receive a hand, the hand covering having an outer surface and an inner surface, an electrically conductive tape extending longitudinally down the palm portion to the cuff on said inner surface and from the cuff up the palm portion on said outer surface, said electrically conductive tape for contacting the hand and an object having substantially higher potential than ground such that an electric circuit is completed between the object and ground.

* * * * *